US008984854B2

(12) United States Patent
Rosse

(10) Patent No.: US 8,984,854 B2
(45) Date of Patent: Mar. 24, 2015

(54) FURNACE AND DUCTWORK IMPLOSION INTERRUPTION AIR JET SYSTEM

(75) Inventor: Frederick Robert Rosse, Meadowbrook, PA (US)

(73) Assignee: Aecom, Los Angeles, CA (US)

( * ) Notice: Subject to any disclaimer, the term of this patent is extended or adjusted under 35 U.S.C. 154(b) by 1739 days.

(21) Appl. No.: 11/906,648

(22) Filed: Oct. 2, 2007

(65) Prior Publication Data

US 2008/0083221 A1 Apr. 10, 2008

Related U.S. Application Data

(60) Provisional application No. 60/849,270, filed on Oct. 4, 2006.

(51) Int. Cl.

| | |
|---|---|
| ***F23J 15/00*** | (2006.01) |
| ***F02G 3/00*** | (2006.01) |
| ***F01K 13/02*** | (2006.01) |
| ***F01K 7/24*** | (2006.01) |
| ***F23J 11/00*** | (2006.01) |

(52) U.S. Cl.

CPC ..... *F23J 11/00* (2013.01)
USPC ..... 60/39.091; 60/646; 60/658; 110/203

(58) Field of Classification Search

USPC ..... 60/39.5, 39.091, 779, 658, 646, 39.13, 60/39.17, 39.53, 39.59, 782, 785, 803, 60/231, 686, 685, 689; 239/265.17; 110/203, 215; 123/319

See application file for complete search history.

(56) References Cited

U.S. PATENT DOCUMENTS

| | | | | |
|---|---|---|---|---|
| 2,428,136 | A * | 9/1947 | Barr | 60/39.17 |
| 2,793,493 | A * | 5/1957 | Kadosch et al. | 239/265.17 |
| 3,132,474 | A * | 5/1964 | Fox | 60/310 |
| 3,132,476 | A * | 5/1964 | Conrad | 239/265.17 |
| 3,369,361 | A * | 2/1968 | Craig | 60/39.5 |
| 3,708,958 | A * | 1/1973 | Duty et al. | 95/94 |
| 3,962,864 | A * | 6/1976 | Williams et al. | 60/791 |
| 4,039,307 | A * | 8/1977 | Bondor | 96/235 |
| 4,907,406 | A * | 3/1990 | Kirikami et al. | 60/39.182 |
| 4,999,167 | A * | 3/1991 | Skelley et al. | 422/175 |
| 5,097,656 | A * | 3/1992 | Napier | 60/39.5 |
| 5,855,111 | A * | 1/1999 | Oguchi et al. | 60/39.5 |
| 6,996,973 | B2 * | 2/2006 | Dujarric | 60/204 |
| 7,055,324 | B2 * | 6/2006 | DePenning et al. | 60/646 |

* cited by examiner

*Primary Examiner* — Gerald L Sung

(74) *Attorney, Agent, or Firm* — David Silverstein; Onello & Mello, LLP.

(57) ABSTRACT

Apparatus and methods are disclosed for rapidly counteracting a transient low-pressure condition, that can occur intermittently in the exhaust section of a power plant or other such industrial facility upstream of exhaust fans as a result of an event that interrupts the generation and/or flow of exhaust gases, using jet nozzles disposed in the exhaust section and connected to a source of pressurized air or other suitable momentum material. By orienting the jet nozzles in a direction generally opposite to the flow of exhaust gas and actuating the system to release a burst of compressed air, for example in the event of a power plant interruption, the low-pressure condition can be ameliorated preventing damage to the exhaust section.

26 Claims, 1 Drawing Sheet

IMPLOSION INTERRUPTION JET SYSTEM SCHEMATIC DIAGRAM

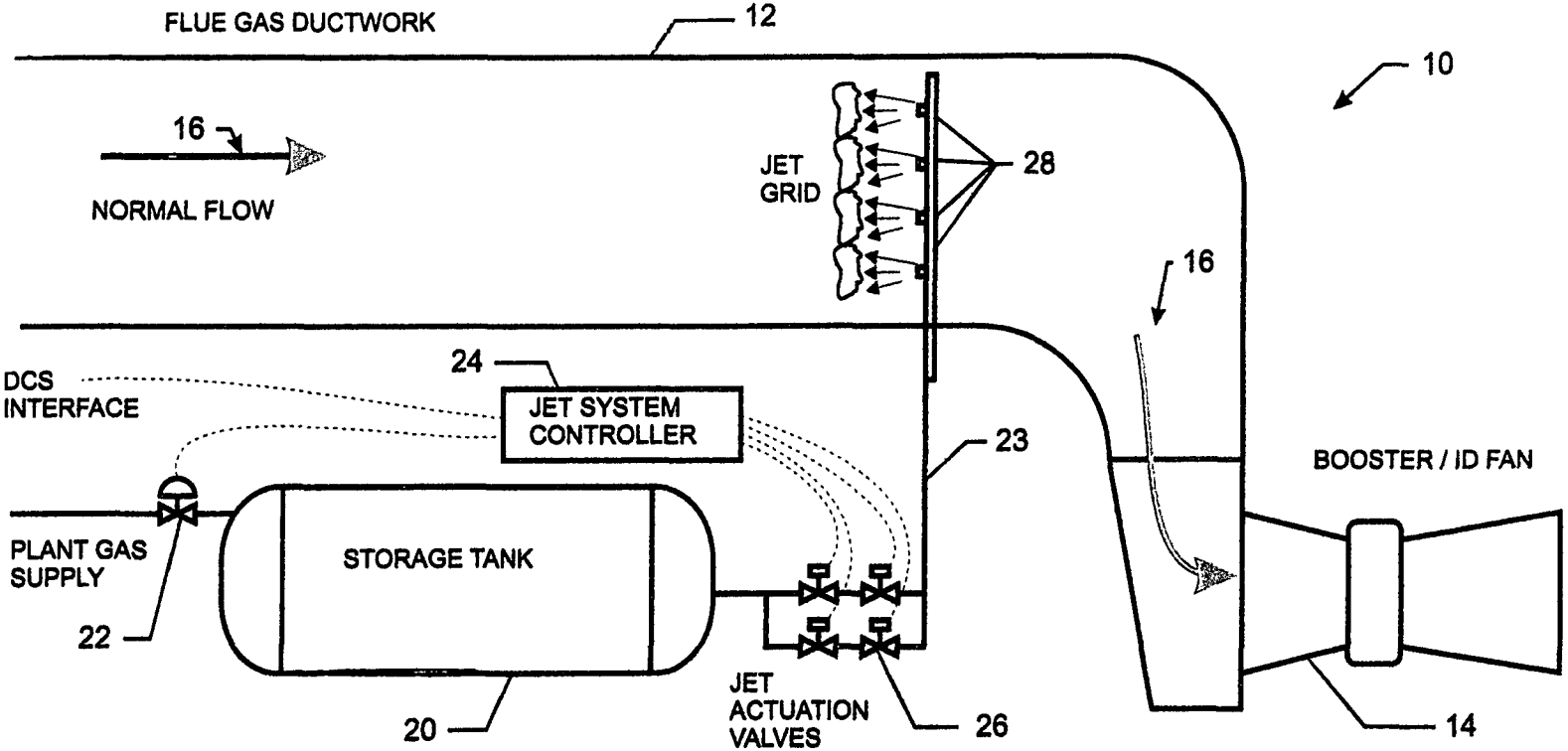
IMPLOSION INTERRUPTION JET SYSTEM SCHEMATIC DIAGRAM

FURNACE AND DUCTWORK IMPLOSION INTERRUPTION AIR JET SYSTEM

CROSS-REFERENCE TO RELATED APPLICATIONS

This application claims benefit of the filing date of U.S. Provisional Application Ser. No. 60/849,270 filed Oct. 4, 2006.

FIELD OF THE INVENTION

The present invention relates generally to furnace and ductwork implosion interruption air jet methods and systems.

BACKGROUND OF THE INVENTION

Power plant boilers typically are subject to an instant fuel flow interruption, or Main Fuel Trip (MFT), due to a multitude of safety and/or equipment protection reasons. When large boilers experience such an instantaneous fuel flow interruption, the hot gasses exiting the furnace rapidly contract as the furnace and flue gas temperatures decay. At the same time, the system Induced Draft and Booster fans continue to force flue gas through and out of the system, with the result that a vacuum condition can occur in the furnace, boiler casing and the associated ductwork upstream of the fan(s). Destructively high vacuum conditions resulting from these factors have caused boiler casing failures and ductwork collapses at numerous power plant installations.

Conventional methods of accommodating these occasional high vacuum conditions include the following:

1. Passive Protection. Passive protection is achieved by designing the boiler and ductwork to withstand the maximum negative pressure that could reasonably occur during a MFT or similar incident.
2. Active Protection. Active protection refers to implementing a mechanism or procedure for rapidly arresting or reducing the negative pressure-generating capability of the fan(s). This is typically accomplished by closing the fan inlet dampers, closing the fan inlet guide vanes, or changing the fan blade pitch for axial flow fans.

While the passive protection method, namely, designing all components to withstand the maximum transient vacuum conditions, is effective, the expense is often excessive. For flue gas treatment system retrofits, re-design and stronger reinforcements for the boiler casing and ductwork may be prohibitively expensive.

The active protection method of control can often also be effective, but it always involves making one or more system compromises. This is because the repositioning of the large dampers or fan blades requires a significant period of time, and during this period of time negative pressures continue to build in the system. There are conditions at some plants where unacceptable negative pressure transients result in spite of these control actions. The generic problem is further exacerbated by the common use of large axial fans for many flue gas retrofit projects. These axial-type fans have inherently slower control/response actions, and hence tend to give larger transient vacuum conditions for a MFT incident.

Accordingly, the prior art approaches to this problem are expensive, are only effective some of the time, and/or impose serious system design and operation limitations.

OBJECTS OF THE INVENTION

Accordingly, a general object of the present invention is to provide an active protection system for rapidly counteracting periodic transient low-pressure or vacuum-inducing conditions in an industrial plant, for example the negative pressure-inducing capability of the induced draft and booster fans of a power plant during a fuel flow interruption or another sudden shut-down incident.

Another general object of this invention is to provide methods and systems to moderate fan-induced vacuum conditions in the ductwork and boiler casings of an industrial plant, for example a power plant during a fuel interruption or similar incident.

A specific object of this invention is to provide methods and systems to substantially immediately counteract furnace and ductwork implosion conditions in power plant operations.

A further specific object of this invention is to provide systems comprising a compressed gas storage tank or an equivalent unit or element connected to an array of jet nozzles, such as air jet nozzles or comparable or equivalent elements, disposed and oriented in power plant flue gas ductwork so as to produce a substantially immediate counterpressure in the ductwork and equipment as large as needed to protect the power plant from damage due to unexpected vacuum conditions resulting from a fuel interruption or other incident causing an interruption in flue gas flow.

These and other objects and advantages of the present invention will be apparent from the following description and the illustrative drawing as discussed below.

SUMMARY OF THE INVENTION

The present invention comprises furnace and power plant ductwork implosion interruption air jet systems and methods that respond to the principal limitations of the prior art approaches. The implosion interruption air jet systems of this invention effectively cancel a potentially destructive boiler implosion condition which can periodically occur in conventional steam-electric power plants. An implosion interruption air jet system in accordance with this invention can be installed as an accessory component to the flue gas draft system of a new or an existing conventional steam-electric power plant. In addition, applications of this invention include flue gas treatment system retrofits in situations where additional draft system fan capacity is to be added, but where the existing ductwork and boiler casings may not be designed to withstand the additional ductwork vacuum that can then occur in these retrofits.

Implosion interruption jet systems according to this invention are appropriate for use in virtually any type of operation producing large volumes of hot exhaust gases in which draft system fans are capable of creating vacuum conditions that can collapse existing ducts, and where available control methods are too slow to provide an adequate response.

The implosion interruption systems of this invention have a relatively low capital cost, significantly less than the potential ductwork reinforcement costs for systems not capable of withstanding the applied transient vacuum condition. The systems of this invention also have significantly enhanced reliability and responsiveness when compared to other established methods of reducing boiler implosion ductwork vacuum conditions, and they are more effective in interrupting and counteracting transient vacuum conditions in such power plant equipment.

In more specific embodiments, this invention comprises:

(1) An implosion interruption system for rapidly counteracting transient low-pressure conditions in an exhaust section of a power plant or comparable industrial plant through which plant exhaust gases pass, said system comprising in combination: a source of a momentum material; one or more jet nozzles disposed in an exhaust section of a an industrial plant and oriented in a direction generally opposite to a direction of exhaust gas flow through that exhaust section; and, one or more conduits connecting the source of momentum material to the jet nozzles, said conduits each having a material flow control element.

(2) A system as described in paragraph (1) above wherein the exhaust section of the industrial plant in which the jet nozzles are disposed is upstream from an exhaust fan of the plant.

(3) A system as described in paragraph (1) above wherein the momentum material is selected from the group consisting of: compressed air; a compressed gas other than air; a liquid; and a finely powdered solid.

(4) A system as described in paragraph (1) above wherein the source of momentum material is a tank of compressed air.

(5) A system as described in paragraph (4) above further wherein said tank of compressed air is connected to a source of compressed air from another part of the plant.

(6) A system as described in paragraph (1) above wherein the material flow control element is a valve.

(7) A system as described in paragraph (1) above further comprising an actuation system for automatically actuating the implosion interruption system as needed.

(8) A system as described in paragraph (1) above wherein said jet nozzles are disposed in an array that substantially spans an exhaust duct of said plant.

(9) Improvements in a power plant wherein a fuel is combusted to generate power and the combustion process produces an exhaust gas which is exhausted through an exhaust section of the power plant with the assistance of one or more exhaust fans, the improvements comprising:

one or more jet nozzles disposed in said exhaust section upstream or downstream of said exhaust fans, said jet nozzles being oriented in a direction generally opposite to a direction of exhaust gas flow;

a source of momentum material and a propelling mechanism to impart velocity to the momentum material in a reverse flow direction; and, a material flow connection between the source of momentum material and the jet nozzles when compressed gas is used as the momentum material.

(10) A power plant as described in paragraph (9) above wherein the momentum material is selected from the group consisting of: compressed air; a compressed gas other than air; a liquid; and a finely powdered solid.

(11) A power plant as described in paragraph (9) above wherein the source of momentum material is a tank of compressed air.

(12) A power plant as described in paragraph (9) above wherein said tank of compressed air is connected to a source of compressed air from another part of the power plant.

(13) A power plant as described in paragraph (9) above further comprising an actuation system for automatically actuating the implosion interruption system as needed.

(14) A power plant as described in paragraph (9) above wherein said jet nozzles are disposed in an array that substantially spans an exhaust duct of said power plant.

(15) A method for rapidly counteracting transient low-pressure conditions in an exhaust section of an industrial plant through which plant exhaust gases pass, said method comprising the steps of:

providing a source of momentum material;

providing one or more jet nozzles disposed in an exhaust section of the plant upstream from an exhaust fan of the plant, said jet nozzles being oriented in a direction generally opposite to a direction of exhaust gas flow through that exhaust section;

providing a material flow connection between the source of momentum material and the jet nozzles; and, actuating a flow of the momentum material to said jet nozzles in the event of an exhaust gas flow interruption causing low-pressure conditions in said exhaust section.

(16) A method as described in paragraph (15) above wherein the momentum material is selected from the group consisting of: compressed air; a compressed gas other than air; a liquid; and a finely powdered solid.

(17) A method as described in paragraph (15) above wherein the source of momentum material is a tank of compressed air.

(18) A method as described in paragraph (15) above wherein said tank of compressed air is connected to a source of compressed air from another part of the plant.

(19) A method as described in paragraph (15) above further comprising an actuation system for automatically actuating the implosion interruption system as needed.

(20) A method as described in paragraph (15) above wherein said jet nozzles are disposed in an array that substantially spans an exhaust duct of said plant.

BRIEF DESCRIPTION OF THE DRAWINGS

FIG. 1 is a schematic illustration of an embodiment of an implosion interruption jet system according to this invention.

DESCRIPTION OF PREFERRED EMBODIMENTS OF THE INVENTION

Systems according to this invention are designed to produce a fan-like action in opposition to the negative pressure effects of the existing Induced Draft and Booster Fans of the particular plant to which the present invention is applied. This is fundamentally accomplished by inserting momentum (mass flow with a significant velocity) in a direction generally opposite to the normal gas flow. In essence, the systems and methods of this invention involve inserting an element or a set of elements at one or more appropriate equipment locations in order to be functionally equivalent to a fan blowing flue gas in the opposite direction at such location(s), thereby canceling the negative pressure transient conditions during a MFT or similar incident. The systems of this invention can operate with virtually no time delay, and they are designed to be able to produce a counter-pressure in the draft system as large as may be necessary to protect the ductwork and equipment from vacuum conditions. Accepted redundancy and control logic practices adapted to this invention allow the systems to have a reliability which exceeds other active control methods in this field. Specific novel design features of this invention provide systems which readily meet the reliability, maintenance and functional verification requirements typical to the power industry.

In a specific representative embodiment, a system according to this invention consists of a compressed air (or other suitable gas or material) storage tank, standing ready as an energy and counter gas source for the system, together with an array of jet nozzles appropriately positioned and oriented within the flue gas ductwork. When a system according to this invention is put in place and actuated, the jet nozzles produce an ejector (jet pump) action, which acts as a substantially equivalent fan acting in opposition to the fan(s) that are operating to produce negative pressure in the ductwork. This produces a "reverse pumping effect". By selecting and/or adjusting the size of the compressed air (or other suitable material) storage tank, its initial pressure, the sizes of connecting flow paths between the storage tank and the jet nozzles, and the configuration and orientation of the jet nozzle array, the effect of this invention can be tailored substantially to match and counteract a shutdown MFT-induced vacuum effect, or to control and/or moderate other actions taken to reduce the vacuum-creating capacity of the normal draft system fans.

Compressed air is envisioned as the preferred operating medium for typical power plant installations, however virtually any momentum material (other gasses, liquids, or even powdered solids) could be used to produce the desired result. The fundamental technology produces a "reverse pumping effect" by injecting momentum and additional mass flow in a direction generally opposite to the normal exhaust flow direction, and transferring this momentum to the flue gas, thus tending to arrest or reduce the flue gas flowrate. In addition, this method rapidly adds additional materials to a region experiencing low-pressure or vacuum conditions thus also helping to counteract such conditions. Alternative momentum materials to compressed air would be considered based on their relevant properties. For example, inert gasses may be selected to preclude unwanted reactions with the flue gas. Liquids could be selected to suppress temperatures in addition to providing the "reverse pumping effect". Powdered solids, fine enough to effectively transfer their momentum to the flowing flue gas, could be used to provide greater momentum transfer if desired.

FIG. 1 is a schematic illustration of an embodiment of an implosion interruption jet system according to this invention using compressed air. FIG. 1 shows a portion 10 of flue gas ductwork 12 associated with the downstream section of a steam-electric power plant (not shown). The arrows 16 inside the ductwork 12 illustrate the general direction of flow of the hot flue gases coming from the power generation region of the plant under normal operating conditions. As is well-known in this art, the ductwork 12 is associated with a booster/ID fan(s) 14 which, during normal plant operation, assists in evacuating the hot flue gases from the system.

As described above, however, under fuel interruption conditions or another sudden, unexpected plant shutdown incident, the continuing operation of fan(s) 14 for a short time even following shut-off exacerbates the condition of flue gas contraction in the ductwork upstream of the fan(s) and can lead to at least a partial vacuum which can damage the equipment and ductwork. In accordance with the present invention, FIG. 1 shows portion 10 of ductwork 12 fitted with an embodiment of the implosion interruption air jet system designed to moderate and counteract such a tendency to induce vacuum conditions during a fuel interruption incident.

The implosion interruption jet system as shown in FIG. 1 includes a storage tank 20 of compressed gas (typically compressed air), a valve 22 connecting an air supply feed (for example, from another portion of the power plant) to the storage tank 20, an array 28 of a plurality of gas jets disposed inside of and substantially spanning ductwork 12, and a gas jet feed line 23 connecting the array 28 of gas jets to storage tank 20. A set 26 of gas jet actuation valves is located in gas jet feed line 23 to regulate the flow of gas to the array 28 of gas jets, and those gas jet actuation valves may advantageously be automatically controlled by a gas jet system controller 24 and a DCS interface as part of an actuation system for actuating the implosion interruption jet system. The same controller 24 may also be used to control the operation of valve 22, or alternatively, separate controllers can be used. Sensors or other means may be utilized to detect changing pressure conditions in an exhaust section of the power plant and thereby actuate the controller(s). The array 28 of gas jets inside ductwork 12 are preferably arranged in a grid or located around the perimeter of the ductwork and are oriented so as to direct gas, when being operated, in a direction substantially opposite to the normal direction of flow 16 of the flue gases.

Example 1

In this Example, based on several furnace implosion studies, implosion interruption air jet systems in accordance with this invention were evaluated to assess the appropriate implementation and performance parameters. Draft system pressures (or vacuum conditions) are typically measured as "inches water column" (WC). Standard sea-level atmospheric pressure is typically 14.7 PSIA, which equals 407 inches water column (WC), for comparison. For a 750 megawatt coal-fired power plant used in this Example, the transient ductwork pressures resulting from a main fuel trip were as follows:

TABLE 1

| | Calculated Pressure (WC) | Equipment Design Pressure (WC) |
|---|---|---|
| Furnace negative pressure | −7.0 | −7.0 |
| Electrostatic Precipitator | −36.6 | −18.0 |

Based on the data in Table 1, it is clear that the electrostatic precipitator unit would require extensive reinforcement, likely costing several millions of dollars, to withstand the transient pressure (vacuum) conditions created by a fuel interruption if a conventional passive protection approach was adopted. Although the furnace equipment design just barely meets the transient pressure conditions, there is no margin for error. As a result, this equipment as well would likely require expensive reinforcement if this system were using passive protection to guard against transient vacuum conditions.

Instead of using passive protection, however, the power plant of this Example could be equipped with an implosion interruption jet system according to this invention at a fraction of the cost of passive protection. Such a system according to this invention would be at least as effective as the passive protection in preventing implosion failures as well as being adjustable to accommodate different power plant loads, future plant modifications, and other operational variables.

As draft system fans (which cause the high negative pressures, i.e., vacuum conditions, in the flue gas ductwork) become larger and more powerful, the available options to achieve sufficiently rapid control actions become increasingly limited. For example, with the smaller duct fans used in the past, it might have been possible to control fan output (e.g., by shutting off a power supply) within a relatively short period of about 5 to 7 seconds and thereby reasonably quickly eliminate the dangerous negative pressure conditions in the ductwork.

For the fans typically used in new power plant retrofit applications, however, it can take as much as 20 to 25 seconds to obtain a sufficient fan control response. Some fan vendors have suggested that special control options may be capable of reducing that fan response time to about 15 seconds, but there is no current suggestion that a faster control response is achievable. Because of such slow fan control response, additional expensive reinforcement of equipment may be the only viable alternative to the implosion interruption jet systems of this invention.

The systems and methods of this invention, on the other hand, can eliminate or at least reduce the need for ductwork reinforcement by applying strong and rapid corrective draft system pressures during periodic transient vacuum or negative pressure conditions. The systems of this invention can be designed to respond with corrective pressure in time frames ranging from several seconds to as little as a fraction of a second, as needed for the condition being corrected. For typical utility boiler system applications, correction response times will be required within a few seconds to prevent equipment damage. The corrective pressure response will typically need to last from about 10 to 30 seconds, that is, until the normal fan controls have time to become effective.

Thus, the pressure correction provided by the implosion interruption jet systems of this invention cancel out excessive fan vacuum during a transient condition. The magnitude of the pressure correction provided by the jet systems of this invention can range from a fraction of an inch WC to hundreds of inches WC, depending on the application. For typical utility boiler systems, correction response pressures will be in the 10 to 30 inch WC range. For some atypical applications, the jet systems of this invention could be designed to provide corrective pressures ranging to as high as several atmospheres (thousands of inches WC), although this would require an air supply at a higher pressure than is typically found in utility plant systems. In this case, special equipment would be required to recharge the air storage tank following a use of the system.

The size of equipment for the implosion interruption jet system of this invention needed for a large utility boiler can be roughly estimated as follows: The compressed air storage tank is about the size of typical compressed gas tank trucks seen on the highway, i.e., about 7000 to 9000-gallons in size. This tank is about 7 feet in diameter×28 feet long, carrying a pressure of about 125 psig. No special compressed air supply system is required because normally existing plant air systems can charge or recharge such a storage tank. The air tank is preferably located close to the plant's induced draft or booster fans. The piping and valves leading from the air tank to the ducts at the fan inlets might typically be 6 to 8 inches in diameter, with several branches of smaller size. In one embodiment, the air jet grid attaches around the perimeter of the interior of the duct, with typical duct size being on the order of 25 feet×25 feet. Control of the air jet system can be achieved through the plant control system (DCS), or by dedicated electronic controls typical to this industry. Electric or pneumatic valve actuation in the event of a fuel interruption incident is preferably automatically implemented by the air jet system controls. Dotted lines in FIG. 1 represent electrical connections.

An implosion interruption system according to this invention has its greatest effect when initially actuated because at that point the air storage tank is fully charged. The magnitude of the reverse pumping effect decays, however, as the pressure in the air tank gradually decays, which more or less coincides with a gradual reduction of draft fan vacuum-inducing capability resulting from use of the normal fan control methods that, in a preferred embodiment, are employed in conjunction with the methods and systems of this invention. Thus, the transient vacuum-creating condition is managed initially by the implosion interruption jet system of this invention, and finally by the normal draft fan controls.

A system according to this invention is capable of producing corrective draft system pressures for all power plant retrofit conditions. The most severe draft system implosion transients typically occur when a power plant has been retrofitted with new air quality control equipment, coincident with a conversion from a forced draft furnace to a balanced draft unit. The system of this invention, however, can readily accommodate even the large counter pressures that are required to address this type of vacuum control situation.

The grid of air jets which are disposed in the ductwork in accordance with this invention produce only a minimal pressure drop in the ductwork during normal plant operation, in particular less pressure drop than a large damper unit would produce if it were installed in the ductwork to control furnace implosion conditions.

The capital costs associated with this invention are low, and system equipment essentially comprises standard power plant components such as piping, valves, small reservoir tanks, etc. Thus, in general, the present invention can be implemented with off-the-shelf components, and no special elements need to be designed, sized, tooled and/or fabricated specifically for this invention.

By using inexpensive series/parallel solenoid valve arrangements in conjunction with the power plant's DCS, the implosion protection methods and systems of this invention provide much better reliability of action than what is realized by any other active implosion protection schemes. Two-of-three or two-of-four logic schemes, as known in this art, can be employed with this invention to provide the highest reliability of function.

By appropriate selection and/or adjustment of the air reservoir size and charge pressure, the desired implosion protection effect produced in accordance with this invention is variable according to the unit load, cleanliness condition of the gas path, and other relevant operating parameters. In this way, one can assure that the proper amount of pressure compensation is available, and such pressure compensation is adjustable on a real time basis.

In a preferred invention embodiment, the jet nozzles are provided with simple hoods which help to assure that furnace ash conditions will not cause plugging of the jet nozzles. The nozzles are accessible for inspection and cleaning while the plant is in operation. Inspection, system functional verification, and cleaning can all be performed even while the plant is operating. The implosion interruption system of this invention may be continuously operable while maintenance-related functions are performed.

The implosion interruption jet systems of this invention can usually be charged by the already existing power plant compressed air system (for example, using either plant service air or plant instrument air). Charging the air storage tank in this way further reduces capital costs because no new compressors are required, and there is no new auxiliary load at the plant.

The implosion interruption jet systems and methods of this invention also can be designed for installation with the potential for periodic high temperature excursions, with virtually no significant additional expenses.

Analysis and simulation of furnace/power plant draft system transient condition responses can be used to tailor system parameters according to this invention to any furnace/power plant operation. Such analysis and simulation is routinely performed, for example, in connection with major draft system retrofit planning. Scale model testing, as known in this art, can also be used to verify and/or optimize the parameters and performance of this invention.

Although this invention has been described by reference to specific embodiments thereof, it will be understood by those skilled in this art that various changes and modifications may be made in the apparatus components, configuration of the components, and other invention details without departing from the spirit and scope of this invention.

Having described the invention what is claimed is:

1. An implosion interruption system for rapidly counteracting transient low-pressure implosion conditions in an exhaust gas section of an exhaust gas-producing plant through which there is a forward flow of plant exhaust gases during normal plant operation that continues for at least a short period of time even after a plant operation interruption which creates a possible implosion condition, said implosion interruption system comprising in combination: a source of a momentum material; one or more jet nozzles disposed in the exhaust gas section, such jet nozzles oriented to produce a stream of momentum material in a direction generally opposite to the forward flow direction of the exhaust gases through that exhaust gas section; one or more conduits connecting the source of momentum material to the jet nozzles, said conduits having a material flow control element; a propelling mechanism that imparts sufficient velocity to a sufficient mass of the momentum material passing through the jet nozzles to produce a substantially immediate reverse pumping effect that tends to arrest the forward flow of exhaust gases and increase pressure upstream of the jet nozzles to effectively counteract an implosion condition; and, a controller that activates the implosion interruption system at an impending implosion condition.

2. A system according to claim 1 wherein the forward flow of plant exhaust gases is mechanically assisted.

3. A system according to claim 1 wherein the momentum material is selected from the group consisting of: compressed air; a compressed gas other than air; a liquid; and a finely powdered solid.

4. A system according to claim 1 wherein the source of momentum material is a tank of compressed air.

5. A system according to claim 1 wherein the material flow control element is a valve.

6. A system according to claim 1 further comprising an actuation system for automatically actuating the implosion interruption system upon receiving a signal of an impending implosion condition.

7. A system according to claim 1 wherein said jet nozzles are disposed in an array that substantially spans an exhaust duct of said plant.

8. A system according to claim 1 further comprising the following additional features:

(a) the forward flow of plant exhaust gases is assisted by one or more exhaust fan(s);

(b) the momentum material is selected from the group consisting of: compressed air; a compressed gas other than air; a liquid; and a finely powdered solid;

(c) the material flow control element is a valve;

(d) an actuation system responsive to a signal of an impending implosion condition for automatically actuating the implosion interruption system as needed; and, (e) the jet nozzles are disposed in an array that substantially spans an exhaust duct of said plant.

9. A system according to claim 1 wherein the propelling mechanism is capable of substantially arresting the forward flow of exhaust gases rapidly enough to prevent duct and equipment damage due to transient implosion pressure in the exhaust section.

10. A system according to claim 1 wherein the propelling mechanism is capable of substantially arresting the forward flow of exhaust gases in less than about 5 to 7 seconds.

11. A system according to claim 1 wherein the propelling mechanism is capable of substantially arresting the forward flow of exhaust gases in a time frame ranging from several seconds to a fraction of a second.

12. A system according to claim 1 wherein the propelling mechanism is capable of substantially arresting the forward flow of exhaust gases for a period of about 10 to 30 seconds.

13. In a power plant wherein a fuel is combusted to generate power and the combustion process produces an exhaust gas which is exhausted in an exhaust flow direction through an exhaust section of the power plant with the assistance of one or more exhaust fans in fluid communication with the exhaust section wherein fan rotational inertia continues to cause displacement of exhaust gas from the exhaust section for at least a short period of time even after the fan(s) is/are turned off creating a possible low-pressure implosion condition, the improvements comprising:

one or more jet nozzles disposed in said exhaust section, said jet nozzles being oriented in a direction generally opposite to the exhaust flow direction of the exhaust gas;

a source of momentum material and a material flow connection between the source of momentum material and the jet nozzles; and, a propelling mechanism capable of imparting sufficient velocity to a sufficient mass of the momentum material passing through the jet nozzles to substantially immediately tend to arrest the flow of exhaust gas in the exhaust flow direction and increase pressure upstream of the jet nozzles to effectively counteract an implosion condition.

14. A power plant according to claim 13 wherein the momentum material is selected from the group consisting of: compressed air; a compressed gas other than air; a liquid; and a finely powdered solid.

15. A power plant according to claim 13 wherein the source of momentum material is a tank of compressed air.

16. A power plant according to claim 13 further comprising an actuation system for automatically actuating the implosion interruption system upon receiving a signal of an impending implosion condition.

17. A power plant according to claim 13 wherein said jet nozzles are disposed in an array that substantially spans an exhaust duct of said power plant.

18. A power plant according to claim 13 further comprising the following additional features:

(a) the momentum material is selected from the group consisting of: compressed air; a compressed gas other than air; a liquid; and a finely powdered solid;

(b) an actuation system responsive to a signal of an impending implosion condition for automatically actuating the implosion interruption system as needed; and, (c) the jet nozzles are disposed in an array that substantially spans an exhaust duct of said power plant.

19. A system according to claim 13 wherein the propelling mechanism is capable of substantially arresting the flow of exhaust gas in the exhaust flow direction rapidly enough to prevent duct and equipment damage due to transient implosion pressure in the exhaust section.

20. A system according to claim 13 wherein the propelling mechanism is capable of substantially arresting the flow of exhaust gas in the exhaust flow direction in less than about 5 to 7 seconds.

21. A system according to claim 13 wherein the propelling mechanism is capable of substantially arresting the flow of exhaust gas in the exhaust flow direction in a time frame ranging from several seconds to a fraction of a second.

22. A system according to claim 13 wherein the propelling mechanism is capable of substantially arresting the flow of exhaust gas in the exhaust flow direction for a period of about 10 to 30 seconds.

23. An implosion interruption system for rapidly counteracting transient low-pressure implosion conditions in an exhaust gas section of an exhaust gas-producing plant through which there is a forward flow of plant exhaust gases during normal plant operation that continues for at least a short period of time even after a plant operation interruption which creates a possible implosion condition, said implosion interruption system comprising in combination: a source of a momentum material comprising a tank of compressed air; one or more jet nozzles disposed in the exhaust gas section, such jet nozzles oriented to produce a stream of momentum material in a direction generally opposite to the forward flow direction of the exhaust gases through that exhaust gas section; one or more conduits connecting the source of momentum material to the jet nozzles, said conduits having a material flow control element; a propelling mechanism that imparts sufficient velocity to a sufficient mass of the momentum material passing through the jet nozzles to produce a substantially immediate reverse pumping effect that tends to arrest the forward flow of exhaust gases and increase pressure upstream of the jet nozzles to effectively counteract an implosion condition; and, a controller that activates the implosion interruption system at an impending implosion condition.

24. A system according to claim 23 further wherein said tank of compressed air is connected to a source of compressed air from another part of the plant.

25. In a power plant wherein a fuel is combusted to generate power and the combustion process produces an exhaust gas which is exhausted in an exhaust flow direction through an exhaust section of the power plant with the assistance of one or more exhaust fans in fluid communication with the exhaust section wherein fan rotational inertia continues to cause displacement of exhaust gas from the exhaust section for at least a short period of time even after the fan(s) is/are turned off creating a possible low-pressure implosion condition, the improvements comprising:

one or more jet nozzles disposed in said exhaust section, said jet nozzles being oriented in a direction generally opposite to the exhaust flow direction of the exhaust gas;

a source of momentum material comprising a tank of compressed air and a material flow connection between the source of momentum material and the jet nozzles; and, a propelling mechanism capable of imparting sufficient velocity to a sufficient mass of the momentum material passing through the jet nozzles to substantially immediately tend to arrest the flow of exhaust gas in the exhaust flow direction and increase pressure upstream of the jet nozzles to effectively counteract an implosion condition.

26. A power plant according to claim 25 wherein said tank of compressed air is connected to a source of compressed air from another part of the power plant.

* * * * *